US011976433B2

(12) United States Patent
Beardsley et al.

(10) Patent No.: US 11,976,433 B2
(45) Date of Patent: May 7, 2024

(54) METHODS AND SYSTEMS FOR MAINTAINING ARIDITY

(71) Applicants: Jay Beardsley, Wauwatosa, WI (US); Jackie Beardsley, Wauwatosa, WI (US)

(72) Inventors: Jay Beardsley, Wauwatosa, WI (US); Jackie Beardsley, Wauwatosa, WI (US)

( * ) Notice: Subject to any disclaimer, the term of this patent is extended or adjusted under 35 U.S.C. 154(b) by 324 days.

(21) Appl. No.: 17/542,836

(22) Filed: Dec. 6, 2021

(65) Prior Publication Data

US 2023/0175229 A1 Jun. 8, 2023

(51) Int. Cl.
*E02D 31/06* (2006.01)
*E04B 1/70* (2006.01)

(52) U.S. Cl.
CPC ..... *E02D 31/06* (2013.01); *E04B 1/70* (2013.01); *E02D 2600/10* (2013.01)

(58) Field of Classification Search
None
See application file for complete search history.

(56) References Cited

U.S. PATENT DOCUMENTS 2,841,390 A * 7/1958 Urquhart ..... E05F 17/00 49/102
4,660,333 A * 4/1987 Romer ..... E02D 31/02 52/366
4,757,651 A * 7/1988 Crites ..... E04B 1/7023 52/302.3
4,897,973 A * 2/1990 Foster, Jr. ..... E04B 1/92 47/33
5,535,556 A * 7/1996 Hughes, Jr. ..... E04B 1/7023 52/293.3
5,890,334 A * 4/1999 Hughes, Jr. ..... E04B 1/7023 405/229
6,230,468 B1 * 5/2001 Klaus ..... E02D 31/06 52/287.1
7,000,359 B2 * 2/2006 Meyer ..... E04B 1/66 52/506.01
8,181,689 B2 * 5/2012 Gill ..... E06B 3/921 160/202
9,517,778 B2 * 12/2016 Thompson ..... E01F 13/06
10,829,904 B1 * 11/2020 McPherson ..... E02D 19/00
11,035,117 B2 * 6/2021 McNamara ..... E04B 1/41
2001/0023565 A1 * 9/2001 Snider ..... E02D 31/06 52/302.1
2007/0068093 A1 * 3/2007 Grange ..... E02D 31/02 52/169.5
2007/0175113 A1 * 8/2007 Moule ..... E02D 31/06 52/169.5

(Continued)

FOREIGN PATENT DOCUMENTS

KR 100830570 B1 * 5/2008
KR 102153656 B1 * 9/2020

*Primary Examiner* — Joshua K Ihezie
(74) *Attorney, Agent, or Firm* — Chiacchio IP, LLC; Theodore T. Chiacchio

(57) ABSTRACT

Disclosed herein are methods and systems designed to eliminate or otherwise substantially reduce the amount of water from rainfall that comes into contact with the foundation of a building and the basement walls. Methods and systems described herein will in many instances save users thereof thousands of dollars in costs associated with repairing basement walls that have become cracked or otherwise damaged due to exposure to water and associated structural damage.

11 Claims, 6 Drawing Sheets

(56) References Cited

U.S. PATENT DOCUMENTS

| | | | | |
|---|---|---|---|---|
| 2007/0294965 | A1* | 12/2007 | Andras | E02D 31/00 52/169.5 |
| 2008/0005967 | A1* | 1/2008 | Johnson | A01K 1/0236 49/61 |
| 2008/0025795 | A1* | 1/2008 | Purnell | E02D 31/02 405/36 |
| 2016/0280237 | A1* | 9/2016 | Thompson | E05F 15/57 |
| 2019/0264412 | A1* | 8/2019 | Mendler | E21B 7/02 |
| 2019/0277025 | A1* | 9/2019 | Sander | E04B 1/6803 |

* cited by examiner

METHODS AND SYSTEMS FOR MAINTAINING ARIDITY

FIELD OF THE INVENTION

The present disclosure relates to methods and systems designed to maintain aridity by eliminating or otherwise substantially reducing moisture and water accumulation. More particularly, this disclosure relates to methods and systems designed to eliminate or otherwise substantially reduce the amount of water from rainfall that comes into contact with the foundation of a building and basement walls.

BACKGROUND

Rainfall regularly comes into contact with the foundations of houses and other buildings. Water from such rainfall thereafter routinely seeps into such buildings' basement walls. This often causes substantial damage to those basement walls. Such damage results from, by way of example only, the freezing and thawing of water in basement walls and resultant cracking within the walls. Upon such thawing, the water also often enters into basement flooring causing further damage.

Water entering buildings through the foundation also often enters cross-bleeding tubes extending throughout the foundation and often clogs those cross-bleeding tubes. Such clogging, in turn, often disrupts plumbing in the building. Such damage routinely costs thousands of dollars to repair.

The primary conventional remedy relied upon to help address the problems identified above is grading the land abutting the building and the foundation. Such grading involves creating a slope extending upward to the side of the building from a point on the property some distance away from the building. Grading, however, does not adequately address the damage to basement walls caused by water accumulation around the foundation. Water and moisture still routinely traverse the foundation and enter into the basement walls, especially when the graded earth becomes saturated.

What is needed is a method for preventing water, through rainfall, from contacting the foundation of buildings and basement walls. What is needed is a method for maintaining aridity of basement walls that avoids the shortcomings of the conventional method used to do so, namely grading.

Methods and systems described herein solve the shortcomings of grading. Methods and systems described herein provide for maintaining aridity of basement walls thereby saving thousands of dollars by avoiding the need to repair or replace cracked and otherwise damaged basement walls.

SUMMARY

Methods and systems for maintaining aridity of building foundations and basement walls enabled by this disclosure solve deficiencies in the current state of the art. In one embodiment enabled by this disclosure, a method for maintaining aridity of building foundations and basement walls comprises providing a shield component that comprises two or more solid panels. According to such embodiment, a first panel substantially encloses a second panel; and each panel except for the first panel is substantially enclosed within another panel in such manner so as to allow for telescoping expansion of the panels as well as retraction of the panels back from such expansion. Such embodiment may further comprise a release apparatus. Such embodiment may further comprise a control component that may be used to actuate the release apparatus to expand the panels of the shield component in a substantially linear, substantially horizontal, telescoping manner and to retract the panels from such expanded position.

According to an embodiment of this disclosure, systems contemplated by this disclosure may comprise a sensor component for detecting rainfall. Such sensor component may further communicate to the control component a signal when the amount of rainfall exceeds a pre-determined threshold level. The control component may be pre-programmed to automatically actuate release of, or positioning of, panel(s) of the shield component on receipt of such signal.

According to one illustrative, but non-limiting, embodiment, a release apparatus of the present disclosure may be connected to a building at a point that is between approximately 2.75 feet and approximately 4.25 feet above the ground or other surface abutting the building where the release apparatus is connected; the shield component may adjoin the ground abutting the building between approximately 2.5 feet and approximately 4.75 feet away from the building where the release apparatus is connected; and the angle formed between the shield component and the ground may be between approximately 0 degrees and approximately 90 degrees.

According to an embodiment enabled by this disclosure, a release apparatus may comprise a substantially straight rod connected to a building, a carrier connected to a shield component and connected to said rod, and a rotatable handle for manual expansion and retraction of panels of the shield component. According to an alternative embodiment, a release apparatus may comprise a substantially straight rod connected to a building, a carrier connected to a shield component and connected to the rod, and a motor component communicatively connected to the carrier. According to such embodiment, a control component may be communicatively connected to the release apparatus wirelessly.

DETAILED DESCRIPTION

Figure 1:
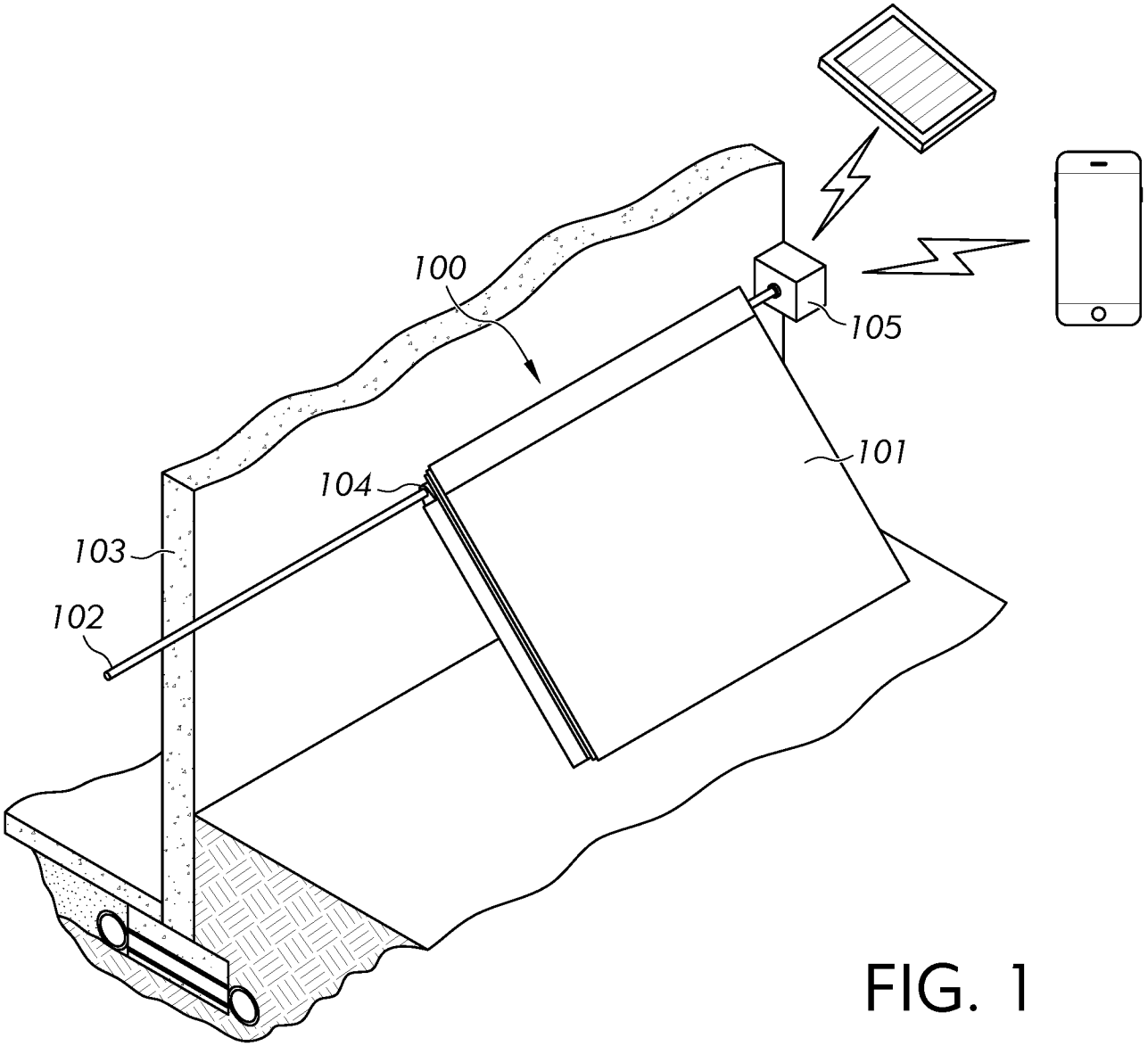
FIG. 1 is a top perspective view of a system of the present disclosure.

The following disclosure is provided to describe various embodiments of methods and systems for maintaining aridity of basement walls. Skilled artisans will appreciate additional embodiments and uses of the methods and systems that extend beyond the examples of this disclosure. Terms included by any claim are to be interpreted as defined within this disclosure. Singular forms should be read to contemplate and disclose plural alternatives. Similarly, plural forms should be read to contemplate and disclose singular alternatives. Conjunctions should be read as inclusive except where stated otherwise.

Expressions such as "at least one of A, B, and C" should be read to permit any of A, B, or C singularly or in combination with the remaining elements. Additionally, such groups may include multiple instances of one or more elements in that group, which may be included with other elements of the group. All numbers, measurements, and values are given as approximations unless expressly stated otherwise.

Terms and expressions used throughout this disclosure are to be interpreted broadly. Terms are intended to be understood respective to the definitions provided by this specification. Technical dictionaries and common meanings understood within the applicable art are intended to supplement these definitions. In instances where no suitable definition can be determined from the specification or technical dictionaries, such terms should be understood according to their plain and common meaning. However, any definitions provided by the specification will govern above all other sources.

Various objects, features, aspects, and advantages described by this disclosure will become more apparent from the following detailed description, along with the accompanying drawings.

For the purpose of clearly describing the components and features discussed throughout this disclosure, some frequently used terms will now be defined, without limitation. The term "aridity" as it is used throughout this disclosure is defined as dryness. The term "building" as it is used throughout this disclosure is defined as a roofed and walled structure built for permanent use, such as, but not limited to, a house. The term "slope" as it is used throughout this disclosure is defined as a slant. The term "lip" as it is used throughout this disclosure is defined as a projecting edge.

Various aspects of the disclosure will now be described in detail, without limitation. In the following disclosure, methods and systems for maintaining aridity of basement walls will be discussed. Those of skill in the art will appreciate that alternative labeling of the methods and systems may be provided, which is consistent with the scope and spirit of this disclosure. Skilled readers should not view the inclusion of any alternative labels as limiting in any way.

The present disclosure concerns systems for maintaining aridity of basement walls. Systems of the present disclosure may comprise a shield component comprising one or more panel aspects, a release apparatus, and a control component.

Systems enabled by the present disclosure may comprise a shield component 100, 200, 300 comprising one or more panel aspects 101, 201, 202, 203, 301, 302, 303 constructed of a substantially solid material. Such substantially solid material should be of sufficient strength and durability so as to maintain structural integrity when exposed to outdoor conditions for a prolonged period of time. Such outdoor conditions may include, without limitation, rainfall.

Figure 2:
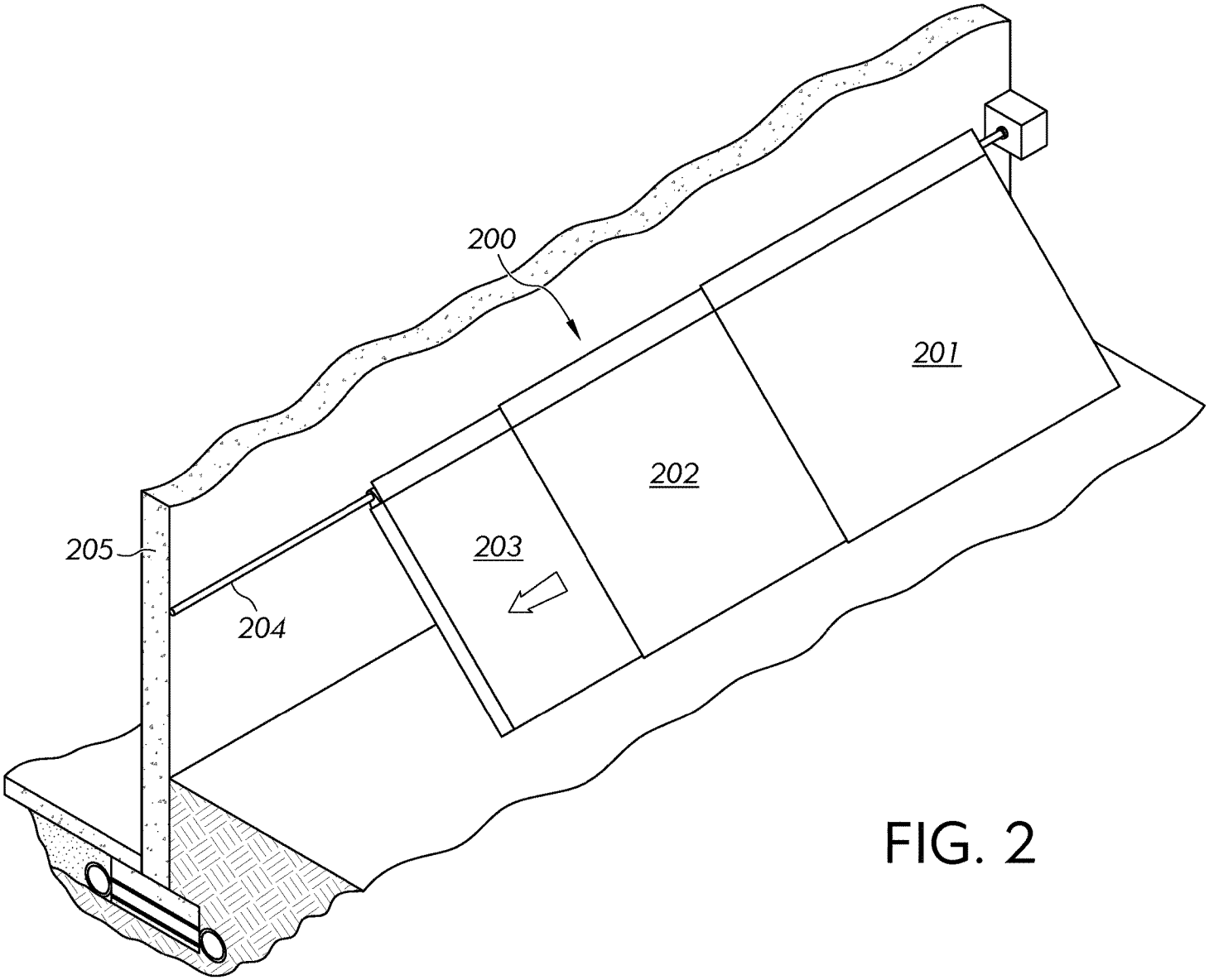
FIG. 2 is a top perspective view of a system of the present disclosure.
Figure 3:
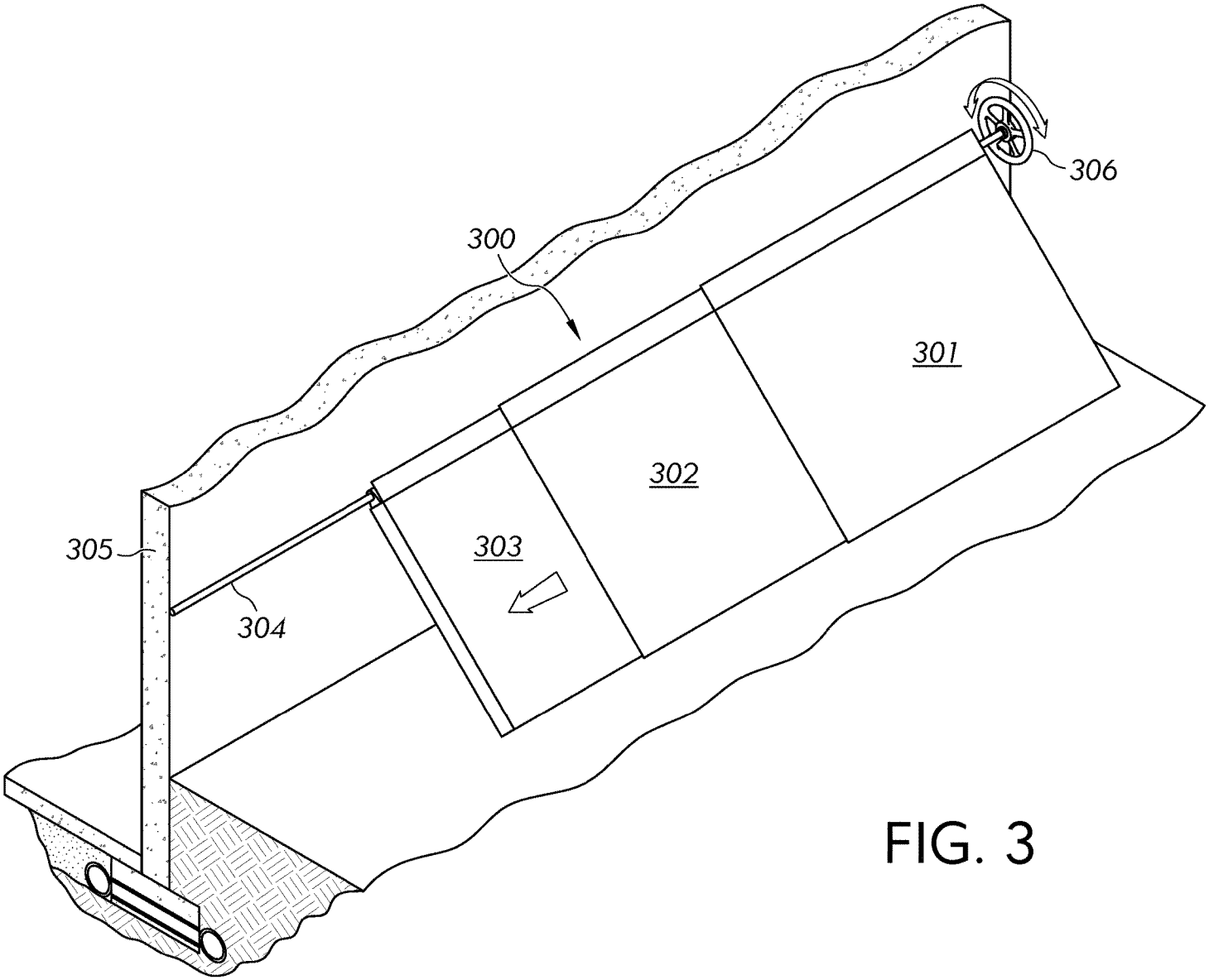
FIG. 3 is a top perspective view of a system of the present disclosure.

In one, non-limiting, embodiment, shield components of the present disclosure may comprise two or more panel aspects, as depicted in FIGS. 2 and 3, each such panel aspect being comprised of a substantially solid material. According to such an embodiment, a first panel aspect 201, 301 substantially encloses a second panel aspect 202, 302. The second panel aspect may substantially enclose a third panel aspect 203, 303. The third panel aspect may substantially enclose a fourth panel aspect. The foregoing configuration may repeat itself such that a last panel aspect may be substantially enclosed, directly or indirectly, within each of the other panel aspects. According to such a configuration, each panel aspect except for the first panel aspect will be substantially enclosed within another panel aspect.

Examples of substantially solid materials suitable for constructing the panel aspects discussed herein include, without limitation, polyethylene, high-density polyethylene, fiberglass, and metal.

Panel aspects of the present disclosure may be positioned one within another when in the maximally contracted state. Upon command, said panel aspects may be extended out in a telescoping manner, as depicted in FIGS. 2 and 3. When maximally expanded in such manner, the shield component may extend along substantially the entirety of a side of a building to which the shield component is connected. Such extension, which may also be referred to as expansion, may occur in a substantially linear and substantially horizontal manner, as depicted in FIGS. 2 and 3. Such extension may be implemented along a side of a building.

Systems of the present disclosure may further comprise a release apparatus. In one, non-limiting, embodiment release apparatuses of the present disclosure may comprise a substantially straight rod 102, 204, 304 connected to a building 103, 205, 305 and extending horizontally alongside such building, a carrier 104 connected to said rod and to the shield component 100 intended to facilitate movement of the shield component along the rod, and a motor component 105. Such motor component may, upon command, actuate the carrier to effectuate expansion of the panel aspects of the shield component in a telescoping manner. Non-limiting examples of such telescopic expansion are depicted in FIGS. 2 and 3.

Figure 6:
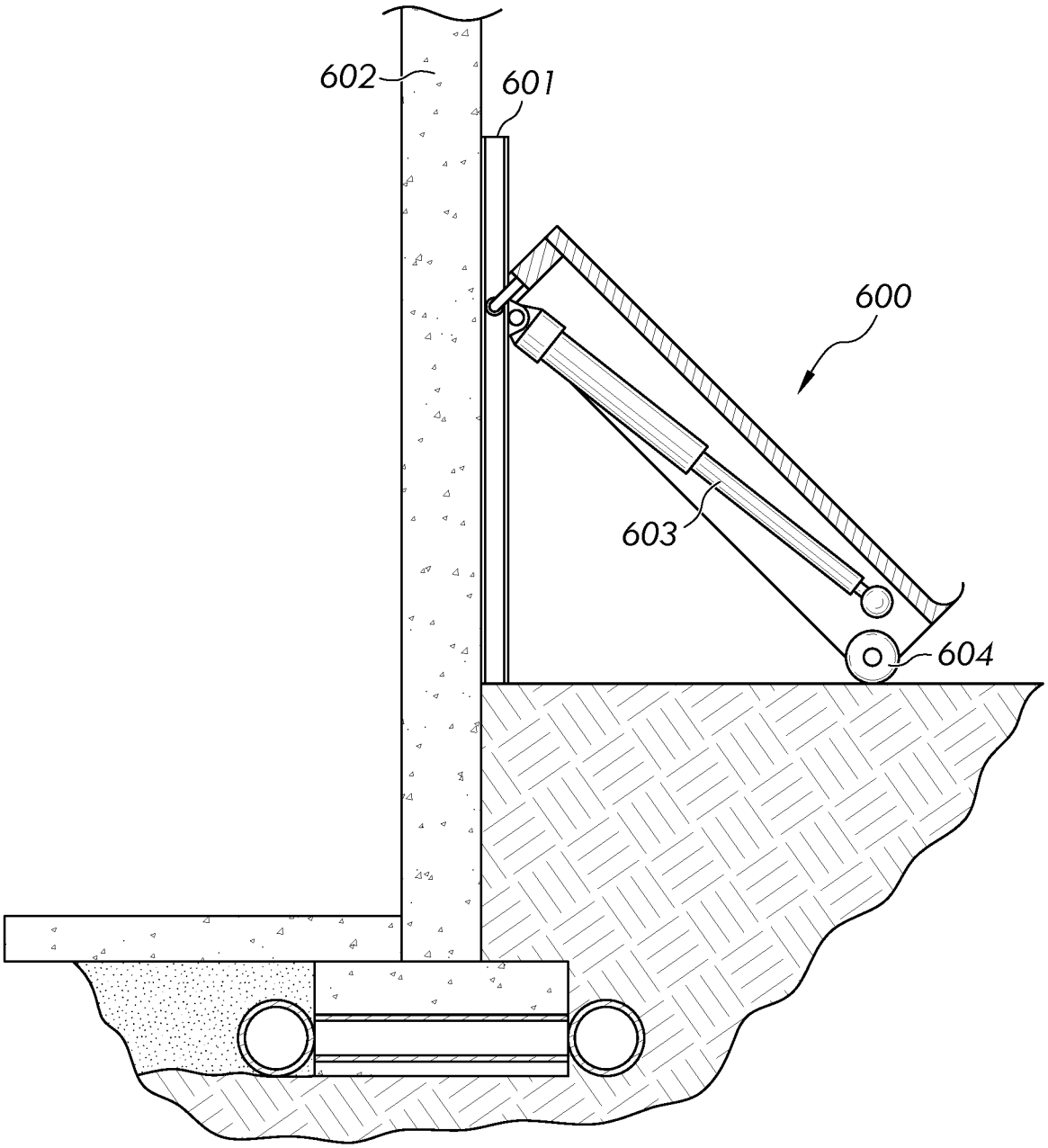
FIG. 6 is a left side view of a system of the present disclosure.

In an alternative embodiment, systems of the present disclosure may comprise a shield component comprising a single panel aspect 400, 500, 600. Said embodiment may further comprise a release apparatus. Said release apparatus may comprise a vertically extending rail aspects 401, 501, 601. Said rail aspects may be connected to a building 402, 502, 602. Such embodiment may further comprise a piston component 603. Such embodiment may further comprise an actuating component such as, without limitation, a motor component or a rotatable handle. Said piston component may be connected to the rail aspect and to the shield component, as depicted in FIG. 6. The shield component may comprise wheels 604 at the terminal end thereof to help prevent dragging of the distal end of the shield component adjoining the ground when the shield component is extending into a downward sloping position.

Release apparatuses of the present disclosure may be positioned on a wall of a building such that, when the shield component is in operation and is maximally extended, the proximal, top, side of the shield component is positioned between approximately 2 feet and approximately 5 feet, preferably between approximately 2.75 feet and approximately 4.25 feet, above the ground or other surface abutting the building where the release apparatus is connected.

Shield components of the present disclosure may be positioned so that, when panel aspects thereof are in an extended or expanded, operative configuration, they adjoin the ground or other surface abutting the building with which they are used at a distance that is between approximately 2.5 feet and approximately 4.75 feet away from the building at approximately the point where the release apparatus is connected. "Adjoin[ing]" in this context should be understood to refer to positioning of the edge or side of the shield component most near the ground or other surface such that it is within approximately 0.5 inches of the ground or other surface. Allowance for such amount of space may be beneficial in that it may avoid potential dragging of such side of the shield component along the ground when extending to an operative position.

Shield components of the present disclosure may be positioned so that they form an angle with the ground or other surface abutting the building in connection with which they are used between approximately 0 degree and approximately 90 degrees, preferably between approximately 40 degrees and approximately 50 degrees. Where some amount of space exists between (i) the side of the shield component parallel to the ground or other surface abutting the building, and most near such ground or other surface; and (ii) the ground or other surface that such side is adjoining, calculation of such angle may be based upon hypothetical closing of such space through further extension of the shield component in a substantially linear manner until it contacts the ground or other surface.

Shield components of the present disclosure may further comprise a curved lip at the terminal side or edge thereof adjoining the ground or other surface.

Systems of the present disclosure may further comprise a control component. Said control component may be communicatively connected to the release apparatus such that manipulation of the control component may dictate positioning and configuration of the shield component and/or panel aspects thereof. Said connection may, without limitation, be wireless.

Alternatively, said control component may comprise a rotatable handle 306. In one such embodiment, upon rotation of the handle in a counter-clockwise direction, panels aspects may telescope outward along a rod 304 such that, when maximally extended, multiple panel aspects may, collectively, shield substantially all of the foundation of a building from exposure to rainfall. According to such embodiment, upon rotation of the handle in a clockwise direction, said panel aspects may contract such that, when maximally contracted, a second panel aspect, third panel aspect, and successive panel aspects as applicable may be housed entirely within a first panel aspect.

Figure 4:
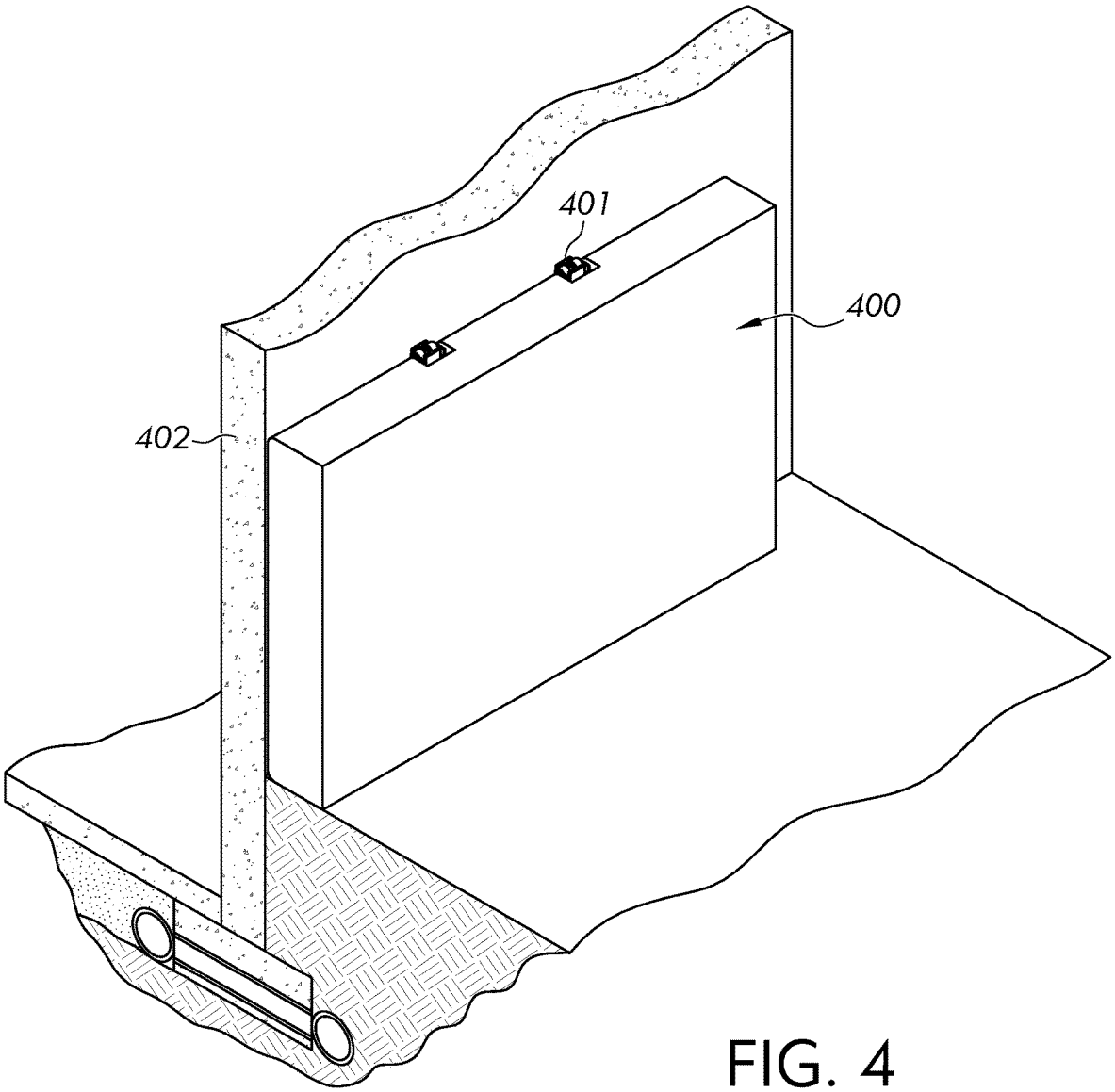
FIG. 4 is a top perspective view of a system of the present disclosure.
Figure 5:
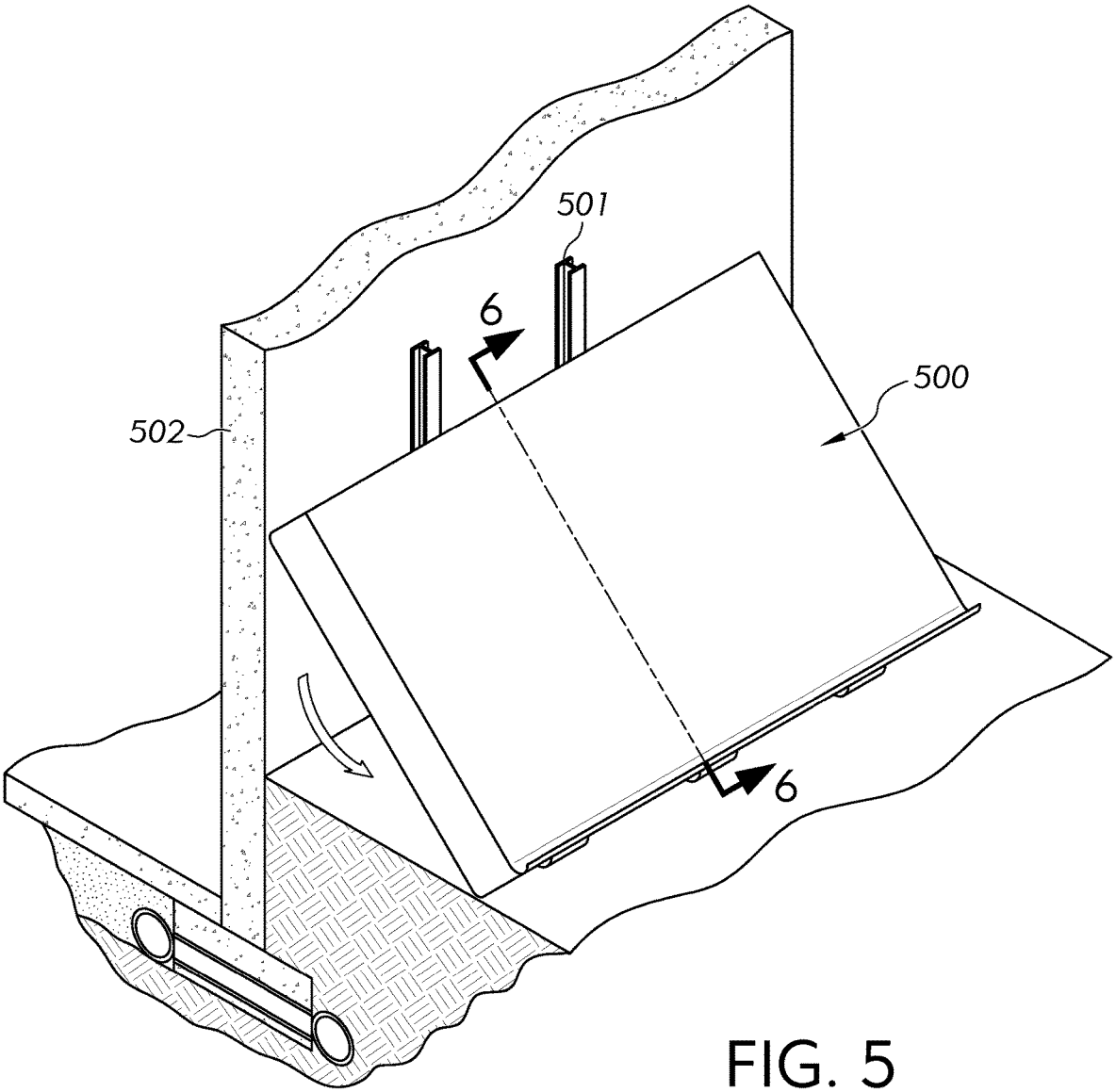
FIG. 5 is a top perspective view of a system of the present disclosure.

In an alternative embodiment involving a rotatable handle, upon rotation of the handle in a counter-clockwise direction, a singular panel aspect as contemplated herein may be actuated along a rail in a manner so that it is positioned in a downward sloping posture. According to such embodiment, upon rotation of the handle in a clockwise direction, said panel aspect may retract along the rail such that, when maximally retracted, the panel aspect may be positioned substantially parallel to a side of a building, as depicted in FIG. 4.

Non-limiting embodiments of systems of the present disclosure may further comprise a sensor component. Said sensor component may detect rainfall and other moisture. Said sensor component may communicate the presence of moisture above a pre-selected threshold level to a display screen accessible by a user of a system of this disclosure. Said sensor component may further automatically cause actuation of a release apparatus of the present disclosure to adjust positioning of a shield component to which said release apparatus may be connected to an operative position when a pre-selected threshold level of moisture has been reached. Such actuation may, without limitation, be accomplished through transmission of a signal from the sensor component to a control component of the present disclosure.

While various aspects have been described in the above disclosure, the description of this disclosure is intended to illustrate and not limit the scope of the invention. The invention is defined by the scope of the claims and not the illustrations and examples provided in the above disclosure. Skilled artisans will appreciate additional aspects of the invention, which may be realized in alternative embodiments, after having the benefit of the above disclosure. Other aspects, advantages, embodiments, and modifications are within the scope of the claims.

The invention claimed is:

1. A method for maintaining aridity of basement walls comprising:

providing a shield component, wherein said shield component comprises two or more panel aspects, each such panel aspect being comprised of a substantially solid material;

wherein a first panel aspect substantially encloses a second panel aspect; and wherein each panel aspect except for the first panel aspect is substantially enclosed within another panel aspect;

providing a release apparatus;

connecting the shield component to the release apparatus;

connecting the release apparatus to a building;

providing a control component communicatively connected to the release apparatus;

entering a command to the control component to actuate the release apparatus to manipulate configuration of the panel aspects.

2. The method of claim 1, wherein upon actuation, the panel aspects telescopically extend out from one another in a substantially linear, substantially horizontal direction.

3. The method of claim 1, wherein the release apparatus is connected to the building at a point that is between 2.75 feet and 4.25 feet above the ground or other surface abutting the building where the release apparatus is connected.

4. The method of claim 3, wherein the shield component adjoins the ground or other surface abutting the building between 2.5 feet and 4.75 feet away from the building where the release apparatus is connected.

5. The method of claim 4, wherein the angle formed between the shield component and the ground or other surface is between 0 degrees and 90 degrees.

6. The method of claim 5, wherein the panel aspects are comprised of at least one material selected from the group of materials consisting of the following: polyethylene, high-density polyethylene, fiberglass, and metal.

7. The method of claim 6, wherein the shield component comprises a curved lip at the edge thereof adjoining the ground or other surface.

8. The method of claim 7, wherein the release apparatus comprises a substantially straight rod connected to the building, a carrier connected to said rod and connected to the shield component, and a rotatable handle.

9. The method of claim 7, wherein the release apparatus comprises a substantially straight rod connected to the building, a carrier connected to said rod and connected to the shield component, and a motor component communicatively connected to the carrier.

10. The method of claim 9, wherein the control component is connected to the release apparatus wirelessly.

11. A method for maintaining aridity of basement walls comprising:

providing a substantially solid shield component comprised of a single panel aspect;

providing a release apparatus, wherein the release apparatus comprises:

a rail aspect connected to a building;

a piston component connected (i) to the shield component, and (ii) to the rail aspect; and, an actuating component;

providing a control component communicatively connected to the release apparatus;

entering a command to the control component to actuate the release apparatus to modulate configuration of the shield component; providing a sensor component communicatively connected to the control component; and setting a pre-determined threshold level of rainfall above which the sensor component will communicate a signal to the control component to actuate the release apparatus.

* * * * *